US012078380B2

(12) United States Patent
Alphonso

(10) Patent No.: US 12,078,380 B2
(45) Date of Patent: Sep. 3, 2024

(54) REFRIGERANT GAS SENSOR

(71) Applicant: Danfoss A/S, Nordborg (DK)

(72) Inventor: Wayne Edgar Alphonso, Nordborg (DK)

(73) Assignee: DANFOSS A/S, Nordborg (DK)

( * ) Notice: Subject to any disclaimer, the term of this patent is extended or adjusted under 35 U.S.C. 154(b) by 0 days.

(21) Appl. No.: 17/836,024

(22) Filed: Jun. 9, 2022

(65) Prior Publication Data

US 2023/0400217 A1 Dec. 14, 2023

(51) Int. Cl.
*F24F 11/89* (2018.01)
*F24F 11/36* (2018.01)
*F24F 110/65* (2018.01)

(52) U.S. Cl.
CPC ..... *F24F 11/89* (2018.01); *F24F 11/36* (2018.01); *F24F 2110/65* (2018.01)

(58) Field of Classification Search
CPC ..... F24F 11/36; F24F 11/89; F25B 2500/222
See application file for complete search history.

(56) References Cited

U.S. PATENT DOCUMENTS 4,713,271 A * 12/1987 Searl ..... B29C 44/507 138/155
9,719,248 B1 * 8/2017 Meacham ..... E01D 19/06
10,837,663 B2 * 11/2020 Kanematsu ..... F24F 7/08
2002/0127078 A1 * 9/2002 Schorr ..... B61D 3/187 410/87
2017/0314805 A1 * 11/2017 Ikawa ..... F25B 49/02
2018/0023820 A1 * 1/2018 Kim ..... F24F 13/30 250/435
2018/0313591 A1 * 11/2018 Obara ..... F24F 11/89
2019/0170716 A1 * 6/2019 Sim ..... H04M 1/026
2020/0088434 A1 * 3/2020 Diaz ..... F24F 11/56
2020/0208860 A1 * 7/2020 Watanabe ..... F24F 11/36

(Continued)

FOREIGN PATENT DOCUMENTS

ES 2856963 T3 * 9/2021 ..... F24F 1/0007
JP WO2020059006 A1 * 6/2017

(Continued)

OTHER PUBLICATIONS

Photodegradation and photostabilization of polymers, especially polystyrene review—Yousif et al.(Year: 2013).*

(Continued)

*Primary Examiner* — Nelson J Nieves
(74) *Attorney, Agent, or Firm* — McCormick, Paulding & Huber PLLC

(57) ABSTRACT

A refrigerant gas leak sensor for a HVAC system includes a housing, a gas sensor core element and mounting means. The housing has primary walls delimiting an inner volume. The gas sensor core element is arranged in the inner volume. The mounting means is configured to attach the housing to a mounting surface, wherein a first surface of a primary wall of the housing faces the mounting surface and wherein a gap is provided between the first surface and the mounting surface. An opening is formed in the housing for exposing the gas sensor core element to gases within the HVAC system, wherein the opening is provided on the first surface. The refrigerant gas leak sensor may be provided as part of an air handling unit.

19 Claims, 11 Drawing Sheets

(56) References Cited

U.S. PATENT DOCUMENTS

| | | | | |
|---|---|---|---|---|
| 2020/0386431 | A1* | 12/2020 | Kondrk | G01N 33/0009 |
| 2021/0018210 | A1* | 1/2021 | Nasis | G01N 33/004 |
| 2021/0108819 | A1 | 4/2021 | Chen et al. | |
| 2021/0302056 | A1* | 9/2021 | Eskew | G01M 1/122 |
| 2023/0003604 | A1* | 1/2023 | West | G01M 3/26 |
| 2023/0029164 | A1* | 1/2023 | De | F25B 13/00 |
| 2023/0062041 | A1* | 3/2023 | Eskew | F24F 11/36 |
| 2023/0117306 | A1* | 4/2023 | Petele | F25B 49/005 62/531 |

FOREIGN PATENT DOCUMENTS

| | | | | |
|---|---|---|---|---|
| JP | 6529685 | B1 * | 6/2019 | F24F 1/0025 |
| SK | 500382012 | U1 * | 10/2012 | |
| WO | WO-2017110904 | A1 * | 6/2017 | F24F 11/89 |

OTHER PUBLICATIONS

Biodegradation of polyethylene a brief review—Yang et al. (Year: 2020).*

* cited by examiner

REFRIGERANT GAS SENSOR

TECHNICAL FIELD

The disclosure relates to the field of refrigerant leak detecting gas sensors for air conditioning systems, such as heating, ventilating and air-conditioning (HVAC) or refrigeration systems.

BACKGROUND

When HVAC or other refrigeration systems use refrigerants exhibiting lower global warming potential (GWP), flammability or toxicity hazards may occur in case of refrigerant leak. This is also true even when using lower toxic or mildly flammable (A2L) refrigerants, such as R32 or R1234ze/yf, or blends such as R454, for example. Mildly flammable refrigerants have an increased potential to burn as their concentration increases. Thus, the incorporation of a refrigerant leak detection mechanism into such systems has become mandatory for safety reasons.

SUMMARY

According to a first aspect, in order to facilitate refrigerant leak detection within HVAC systems, a refrigerant gas leak sensor for a HVAC system includes a housing having primary walls delimiting an inner volume, a gas sensor core element arranged in the inner volume, and mounting means configured to attach the housing to a mounting surface, with a first surface of a primary wall of the housing facing the mounting surface. The mounting means provides a gap between the first surface and the mounting surface. An opening is formed in the housing for exposing the gas sensor core element to gases within the HVAC system. The opening is provided on the first surface.

According to certain embodiments, the housing may include a UV resistant material.

According to other embodiments, dimensions of the gap may be determined to minimize contaminants reaching the gas sensor while facilitating the responsiveness of the gas sensor. Thus, the gap between the housing and the mounting surface may have a width measured between the opening and the mounting surface that is less than 15 mm and/or greater than 1 mm. The gap may have a width measured at an edge of the housing between the first surface and the mounting surface that is less than 20 mm and/or greater than 1 mm. Additionally, the total cross-sectional area of the first surface may be less than 50 $cm^2$ and/or greater than 10 $cm^2$. Further, the gap may have a total volume that is less than 40 $cm^3$ and/or greater than 1 $cm^3$.

To further optimize the functioning of the gas sensor, according to an embodiment, the opening may be located a minimum distance from an edge of the gap. This minimum distance may be less than 5 cm and/or greater than 0.1 cm. The gas sensor core element may be placed adjacent the opening. The gas sensor core element has a sensing surface which may be positioned flush with the first surface of the housing. Alternatively, the gas sensing surface may be positioned within the inner volume, below the level of the first surface. A distance between the first surface and the gas sensing surface may be less than 20 mm and/or greater than 0 mm. Optionally, a ducting element, which extends within the inner volume from the first surface toward the gas sensing surface, may be provided.

According to a further embodiment, the housing may include one or more secondary walls not delimiting the inner volume. A secondary wall which extends toward the mounting surface to at least partially block the gap may be provided.

According to another aspect, an air handling unit for an HVAC system includes an enclosure for the air handling unit, a heat exchanger arranged within the enclosure for heat transfer between a refrigerant flowing in refrigerant piping and an air flow passing through the air handling unit, and a refrigerant gas leak sensor according to the first aspect disclosed above arranged within the enclosure. A UV source and/or an IR source may be arranged within the enclosure. Additionally, a controller configured to receive signals from the refrigerant gas leak sensor may be provided. When the refrigerant gas leak sensor detects a leak, the controller may, for example, trigger an alarm, shut a refrigerant valve, operate a fan, and/or open a vent. The refrigerant gas leak sensor may be located downstream of the heat exchanger and/or the refrigerant gas leak sensor may be located within the lower half of the enclosure. The UV source may be located upstream of the heat exchanger.

BRIEF DESCRIPTION OF THE DRAWINGS

Example embodiments of the present invention will now be illustrated with reference to the following Figures.

FIG. 2*a* is a front view; FIG. 2*b* is a sectional view taken through 2*b*-2*b* of FIG. 2*a*; FIG. 2*c* is a side sectional view taken through 2*c*-2*c* of FIG. 2*d*; and FIG. 2*d* is an isometric view.

FIG. 3*a* is a front view; FIG. 3*b* is a sectional view taken through 3*b*-3*b* of FIG. 3*a*; FIG. 3*c* is a side sectional view taken through 3*c*-3*c* of FIG. 3*d*; and FIG. 3*d* is an isometric view.

FIG. 4*a* is a front view; FIG. 4*b* is a sectional view taken through 4*b*-4*b* of FIG. 4*a*; FIG. 4*c* is a side sectional view taken through 4*c*-4*c* of FIG. 4*d*; and FIG. 4*d* is an isometric view.

FIG. 5*a* is a front view; FIG. 5*b* is a sectional view taken through 5*b*-5*b* of FIG. 5*a*; FIG. 5*c* is a side sectional view taken through 5*c*-5*c* of FIG. 5*d*; and FIG. 5*d* is an isometric view.

FIG. 6*a* is a front view; FIG. 6*b* is a sectional view taken through 6*b*-6*b* of FIG. 6*a*; FIG. 6*c* is a side sectional view taken through 6*c*-6*c* of FIG. 6*d*; and FIG. 6*d* is an isometric view.

The scope of the present invention is not limited to the above schematic drawings, the number of constituting components, the relative arrangement thereof, etc. These drawings are disclosed simply as examples of embodiments.

DETAILED DESCRIPTION

With the advent of the use of moderate-to-low GWP refrigerants, the use of refrigerant gas leak detecting sensors has become mandatory for indoor units of heating, ventilating and air-conditioning (HVAC) systems for safety reasons.

Preferably, such sensors are installed within the air handling units of the HVAC systems, e.g. in indoor units of residential HVAC systems. Such units typically include heat exchangers and fans, and leaking of refrigerant is most likely occurring and most critical within these units. However, the refrigerant gas leak sensors could also be arranged outside the HVAC unit enclosure, for example in air ducts of the HVAC system near the outlet of the unit.

Air flow drawn through the unit by the fan is cooled or heated when passing the coils or plates of the heat exchanger. The air flow may also be exposed to intense ultraviolet (UV) light for air purification reasons before leaving the HVAC unit. Therefore, the refrigerant gas leak sensors to be applied in such units are preferably protected from direct UV light, which otherwise might deteriorate or even destroy the sensor element and/or sensor electronics of the refrigerant gas leak sensor.

Further, the refrigerant gas leak sensors are preferably protected from infrared radiation (IR), as air handling units often comprise high intensity IR sources, such as electric or gas heaters integrated in the HVAC unit.

Refrigerant fluid flowing through the heat exchanger may also contain a certain amount of refrigerant oil for lubrication of specific components of the refrigerant system, such as compressors. Therefore, in case of leaking from the refrigerant piping or from the heat exchanger within the HVAC unit, the leak sensor element is preferably further be protected from oil spray, which might lead to compromising measurement performance by clogging of the sensor element.

Figure 1:
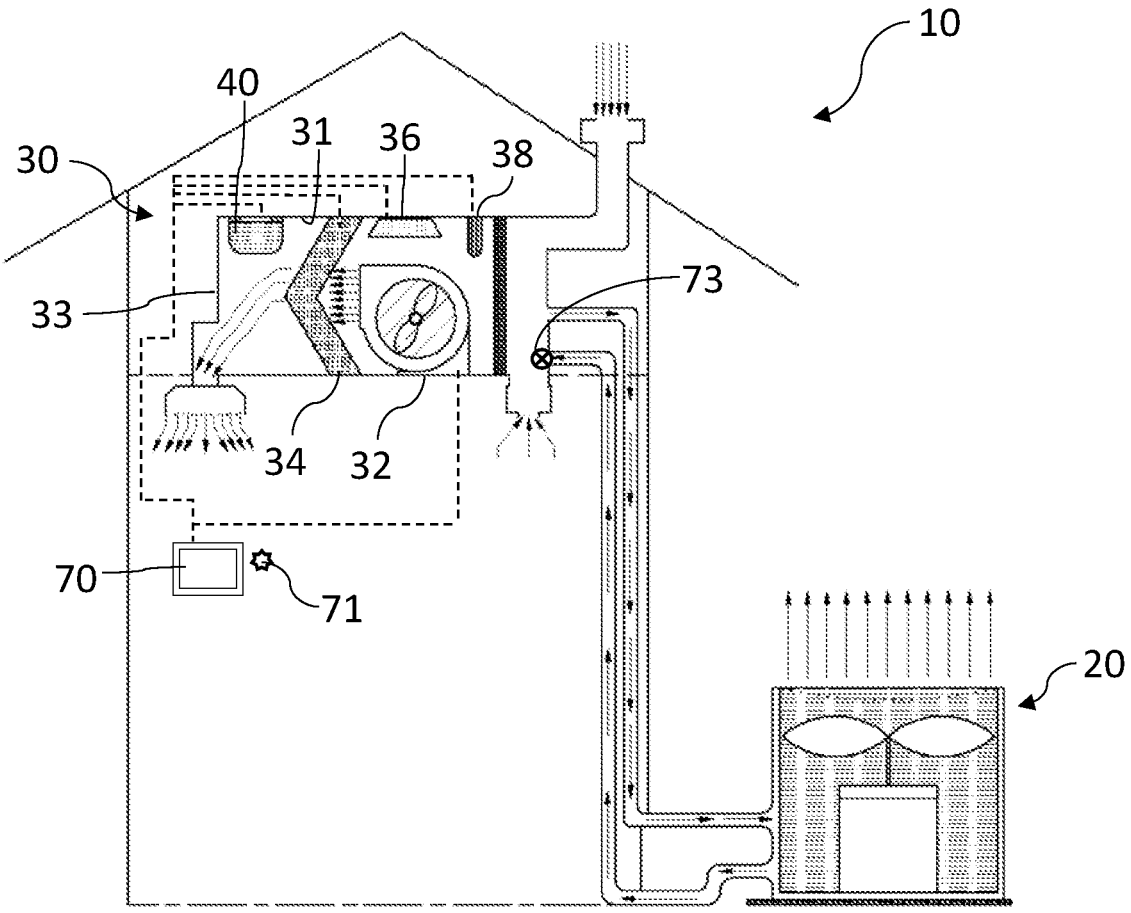
FIG. 1 is schematic illustrating of an embodiment of a residential HVAC system in accordance with an aspect of the present invention.

FIG. 1 shows a residential refrigeration system 10 including an outdoor unit 20 located outside the residence and an indoor unit 30 located in an attic. A pair of connecting pipes extend between the outdoor unit 20 and the indoor unit 30 for circulating a refrigerant between the units. As noted above, the refrigerant may be flammable or mildly flammable.

Further, a controller 70 for controlling the operation of the refrigeration system is shown. Controller 70 may receive and/or send signals from any of the sensing and/or functional units. When a refrigerant gas leak is detected, the controller 70 may implement specific safety functions including, for example, triggering an alarm 71, shutting off a refrigerant shutoff valve 73, operating a fan to diffuse the leaked refrigerant, and/or opening a vent.

Indoor unit 30 may include an air handling element, for example, a fan 32 which drives air past a heat exchanger 34. A UV light 36, IR heater 38 and a gas leak sensor 40 are also shown located within indoor unit 30. The UV light 36 and IR heater 38 are shown positioned to the upstream side of the heat exchanger 34, while the gas leak sensor 40 is shown positioned to the downstream side of the heat exchanger 34. UV light 36, IR heater 38 and gas leak sensor 40 are mounted on interior mounting surfaces within an enclosure 33 of the air handling unit 30. Other sensing and/or functional units, configurations, and placements may be provided. For example, gas leak sensor 40 may be located to the upstream side of the heat exchanger or, optionally, located toward the bottom of the indoor unit 30. Locating the gas leak sensor toward the bottom of the unit may be particularly desirable if the refrigerant is heavier than air.

Gas leak sensor 40 is preferably configured for detecting a flammable or mildly flammable refrigerant. Any of a variety of gas leak sensing technologies may be used for detecting the refrigerant. Two commonly known types of gas sensors include nondispersive infrared (NDIR) gas sensors, which determines gas concentrations and which is relatively expensive, and metal oxide semiconductor (MOS) gas sensors. Other gas leakage sensing technologies may be employed.

As shown in the embodiment of FIGS. 2*a*-2*d*, a refrigerant gas leak sensor 40 for an HVAC system includes a housing 42 having primary walls 44, 46, 48 delimiting an inner volume 52. A gas sensor core element 54 is arranged in the inner volume 52. One or more mounting means 60 are provided to attach the housing 42 to a mounting surface 31. A first surface 44*a* of a primary wall or a first plate element 44 of the housing 42 faces the mounting surface 31. An opening 58 is formed in the housing 42 for exposing the gas sensor core element 54 to gases within the HVAC system. The mounting means 60 are configured such that a gap 62 between the first surface 44*a* and the mounting surface 31 is provided. The opening 58 is provided on the first surface 44*a*.

Specifically, gas leak sensor 40 includes a housing 42 enclosing in inner volume 52 within which a refrigerant gas sensor core 54 and a carrier substrate 56 are located. Carrier substrate 56 may be a printed circuit board (PCB). Housing 42 includes primary walls 44, 46, 48, e.g., a first plate element 44, a second plate element 46 and side walls 48. First plate element 44 is positioned adjacent to, but offset from, a mounting surface 31 such that a first surface 44*a* faces mounting surface 31. Further, first plate element 44 is provided with an opening 58. Second plate element 46 forms the outer wall of housing 42, i.e. the portion of housing 42 facing away from mounting surface 31. Side walls 48 extend between first plate element 44 and second plate element 46. For example, in one embodiment, the side walls 48 may be integrally formed with the first plate element 44 to form a back cover. In another embodiment, the side walls 48 may be integrally formed with the second plate element 46 to form a front cover.

In general, housing 42 need not be any particular shape. Nor do the plate elements or side walls need to be planar. Similarly, opening 58 need not be any particular shape.

In a preferred embodiment, housing 42 includes a UV resistant material. For example, housing 42 may be formed of UV resistant polymers, metal coated polymers, metals or ceramic materials, etc. As another example, a UV radiation resistant property of housing 42 may be achieved by applying suitable UV resistant materials, such as UV resistant polymers, metal coated polymers, metals or ceramic materials to the outer surface of housing 42. Optionally, housing 42 may include different materials. As one example, only those portions of housing 42 facing away from, or not located adjacent to, mounting surface 31 are made of UV resistant materials.

One or more mounting means 60 are provided for mounting gas leak sensor 40 to the mounting surface 31. Mounting means 60 may include any of various and well-known mounting elements, including mechanical fasteners such as screws, bolts, rivets, etc., adhesives, welds, slip fits, snap fits, press fits, latches, straps, clamps, detents, etc. Mounting means 60 may permanently or releasably attach gas leak sensor 40 to mounting surface 31. Further, mounting means 60 may be included as part of housing 42, may be included as part of mounting surface 31, or may be provided as a separate item for mating housing 42 to the mounting surface 31. For example, mounting means 60 may be provided as separate elements designed to be attached to housing 42 or mounting means 60 may be integrally formed with first plate element 44, second plate element 46 or side walls 48.

Figure 2A:
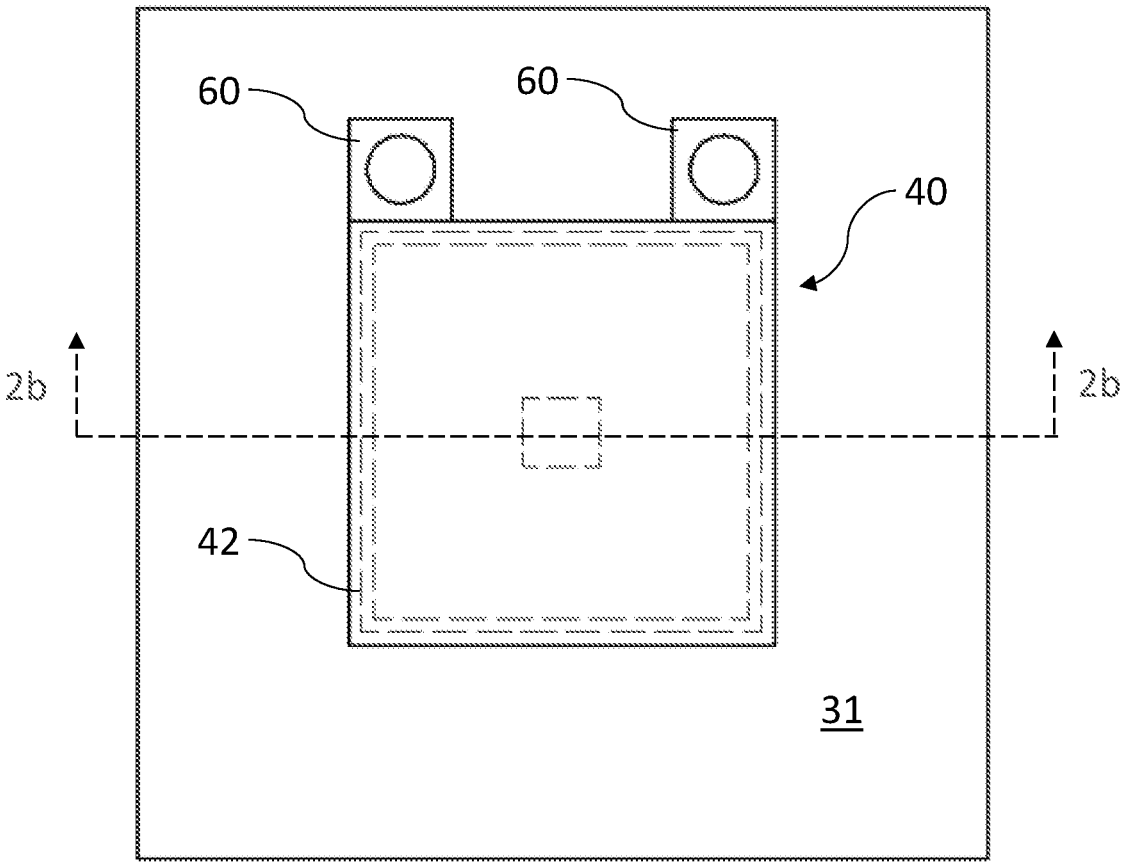
FIGS. 2*a*-2*d* are schematics illustrating an embodiment of a gas leak sensor mounted to a mounting surface with two mounting protrusions in accordance with an aspect of the present invention.
Figure 2B:
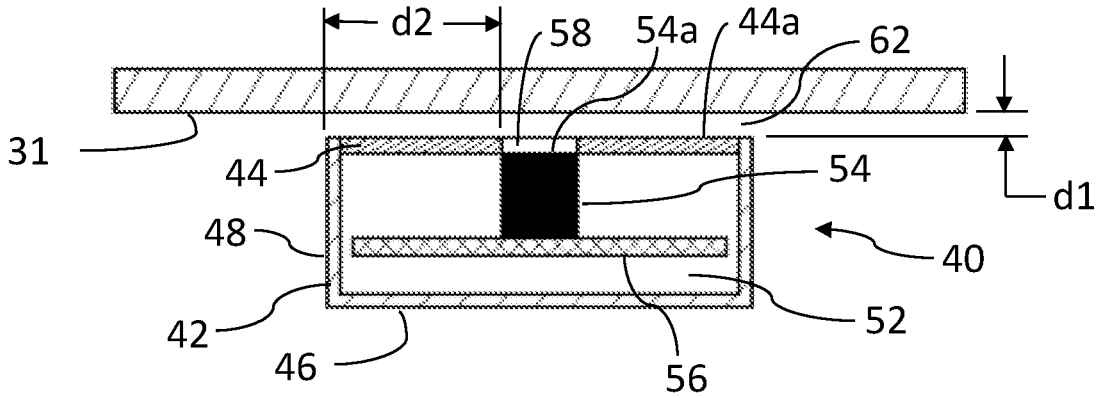
Figure 2C:
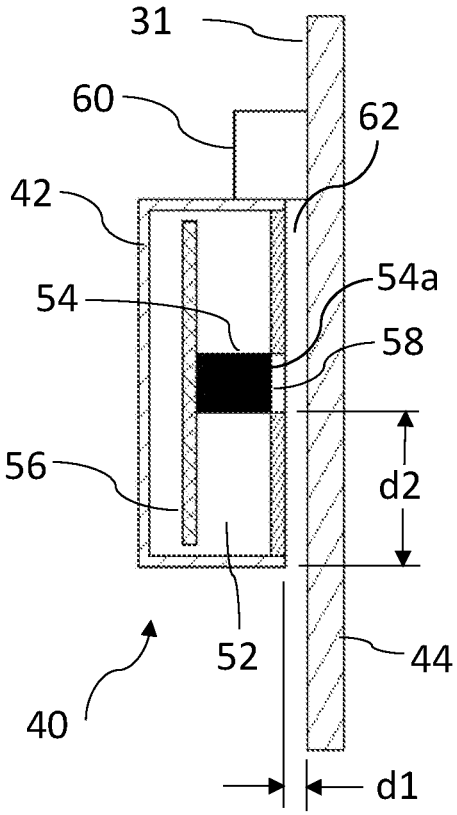
Figure 2D:
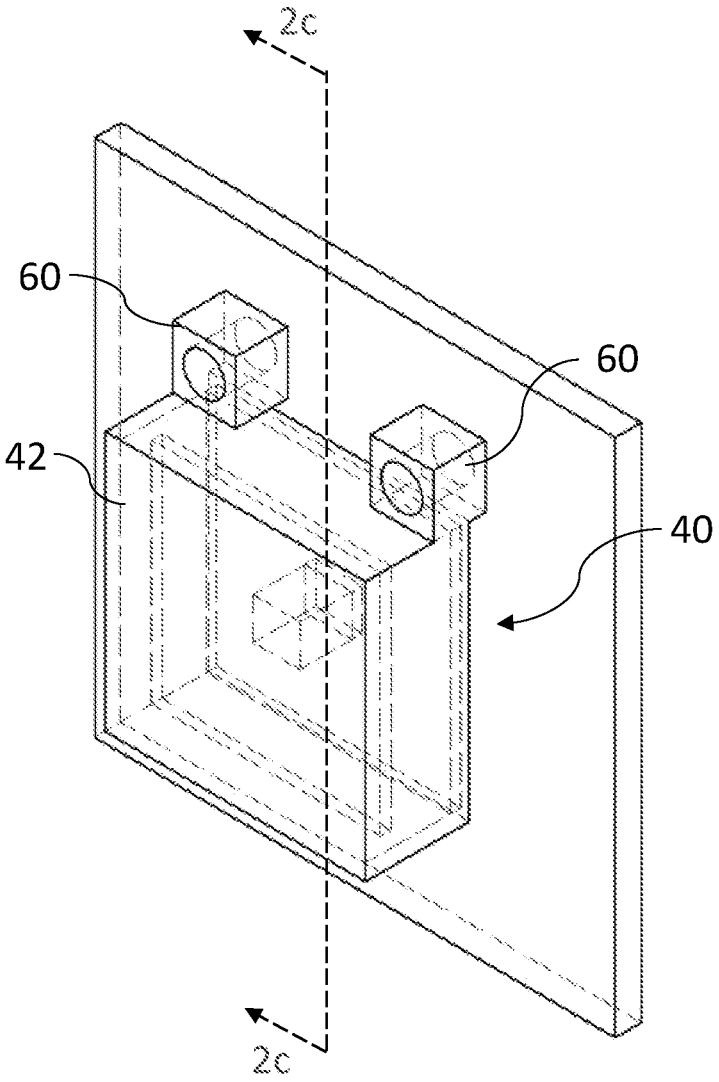

As best shown in FIGS. 2*a* and 2*d*, mounting means 60 may be provided as footed portions, protrusion elements, or flanges integral to housing 42. For example, mounting means 60 may be formed as protrusion elements protruding from the surface plane of first plate element 44. These footed portions, protrusion elements, or flanges may be provided with through holes capable of receiving a fastener (not shown).

Further, as best shown in FIGS. 2*b* and 2*c*, mounting means 60 provides a gap 62 having a gap width or first distance 'd1' between first plate element 44 and mounting surface 31 of the HVAC unit. When first plate element 44 is planar and positioned parallel to mounting surface 31, this gap width 'd1' corresponds to a distance between the opening 58 and the mounting surface 31, a minimum distance between the first surface 44*a* of the first plate element 44 and the mounting surface 31, and a distance between the first plate element 44 and the mounting surface 31 at an edge of housing 42. This gap width 'd1' is measured in a direction perpendicular to the first surface 44*a*. However, if the first plate element 44 is not planar and/or is not positioned parallel to mounting surface 31, this gap width 'd1' between first plate element 44 and the mounting surface 31 may vary depending upon where the distance "d1" is measured. Thus, a gap width 'd1(a)' may correspond to a distance between the first surface 44*a* at the opening 58 and the mounting surface 31, a minimum gap width 'd1(b)' may correspond to a minimum distance between the first surface 44*a* of the first plate element 44 and the mounting surface 31, and a gap width 'd1(c)' may correspond to a distance between the first surface 44*a* of the first plate element 44 and the mounting surface 31 at an edge of housing 42. Typically, the dimensions of the mounting means 60 extending beyond and perpendicular to the first surface 44*a* of a first plate element 44 of the housing 42 determines these gap width dimensions.

According to certain safety standards a leak of a mildly flammable refrigerant must be detected within 10 seconds. Further, the safety standards may specify that the gas sensor be able to detect a leak with a concentration detection accuracy of, for example, within ±15%. Thus, the first and second distances 'd1,' 'd2' may be determined to ensure fast response times of the sensor by providing an adequate cross-sectional area and length of a diffusion passage to enable sufficient air flow in the gap 62 between mounting surface 31 and the gas leak sensor housing 42. Thus, it may be desirable to control the 'd1' and 'd2' dimensions. Further, still referring to FIG. 2*c*, gap 62 may have different dimensions at different locations within gap 62, e.g., at 'a', 'b', and 'c'. For example, gap 62 may have a gap width 'd1(a)', i.e., the distance between the opening 58 and the mounting surface 31, that is less than 15 mm and/or greater than 1 mm. Optionally, gap 62 may have a minimum gap width 'd1 (b)', i.e., the minimum distance between first surface 44*a* and the mounting surface 31, that is less than 15 mm and/or greater than 1 mm. As another example, gap 62 may have a gap width 'd1(c)', i.e., the distance between the first surface 44*a* of the first plate element 44 and the mounting surface 31 at an edge of housing 42 that is less than 20 mm and/or greater than 1 mm.

As shown in FIGS. 2*b* and 2*c*, a second distance 'd2' is defined as the shortest distance between opening 58 and an edge of the gap 62. Typically, this second distance would be measured parallel to mounting surface 31. In the embodiment of FIG. 2, because housing 42 is square, the second distance 'd2' as shown in FIG. 2*b* is equal to the second distance 'd2' as shown in FIG. 2*c*. According to some embodiments, the second distance 'd2', which generally determines the minimum length of the diffusion passage, may be less than 5 cm and/or greater than cm.

In order to, enable sufficient air flow in the gap 62 between mounting surface 31 and the gas leak sensor housing 42, the cross-sectional area of first surface 44*a* and the length of the diffusion passage may be controlled. Generally, if the gap width 'd1' is small (thereby limiting the cross-sectional area of the diffusion passage), then 'd2' would preferably also be small (thereby minimizing the time for the flow of gas to reach the opening 58). Thus, as an example, a cross-sectional area of first surface 44*a* may be less than 50 $cm^2$ and/or greater than 10 $cm^2$. This cross-sectional area may be measured as the total cross-sectional area encompassed by all of the edges of the gap 62 minus the area of the opening 58. Further, the total volume of the gap 62 may influence the response time of the gas sensor 40. Thus, according to one embodiment, a total volume encompassed by the gap 62 may be less than 40 $cm^3$ and/or greater than 1 $cm^3$.

According to one embodiment, the gas leak sensor housing 42 may be square, with each side having a length of 50 mm, for example. The gap width 'd1' may be a uniform 4 mm, for example. Optionally, the gap width 'd1' need not be a uniform width. Thus, for example, the gap width 'd1' may have a width d1(c) at the edge of the gas leak sensor housing 42 that is greater than a width d1(a) at the opening 58.

Mounting surface 31 may be provided as part of enclosure 33 or as a portion of a housing or other structure associated with other components located within enclosure 33. Optionally, mounting surface 31 may be provide as part of a frame or other structure specifically provided for holding gas leak sensor 40. Thus, for example, mounting surface 31 may be a wall portion of the enclosure 33 of the HVAC unit 30, a portion of other structural elements (brackets, stiffeners etc.) of the unit, a portion of the heat exchanger 34 or of other components within the unit, etc. When gas leak sensor 40 is properly mounted to mounting surface 31, mounting surface 31 protects refrigerant gas sensor core 54 against exposure to UV radiation, IR radiation, oil spray, and/or other contaminants.

Housing 42 may provide a gas tight enclosure encompassing inner volume 52, with the exception that opening 58 provides a means for ingress of air or other gases external to housing 42 to come into contact with refrigerant gas sensor core 54, which is located within housing 42. Thus, it is understood that air or gas external to housing 42 may have access to refrigerant gas sensor core 54 via opening 58, but that the air or gases circulating within unit 30 could not otherwise enter inner volume 52.

Figure 3A:
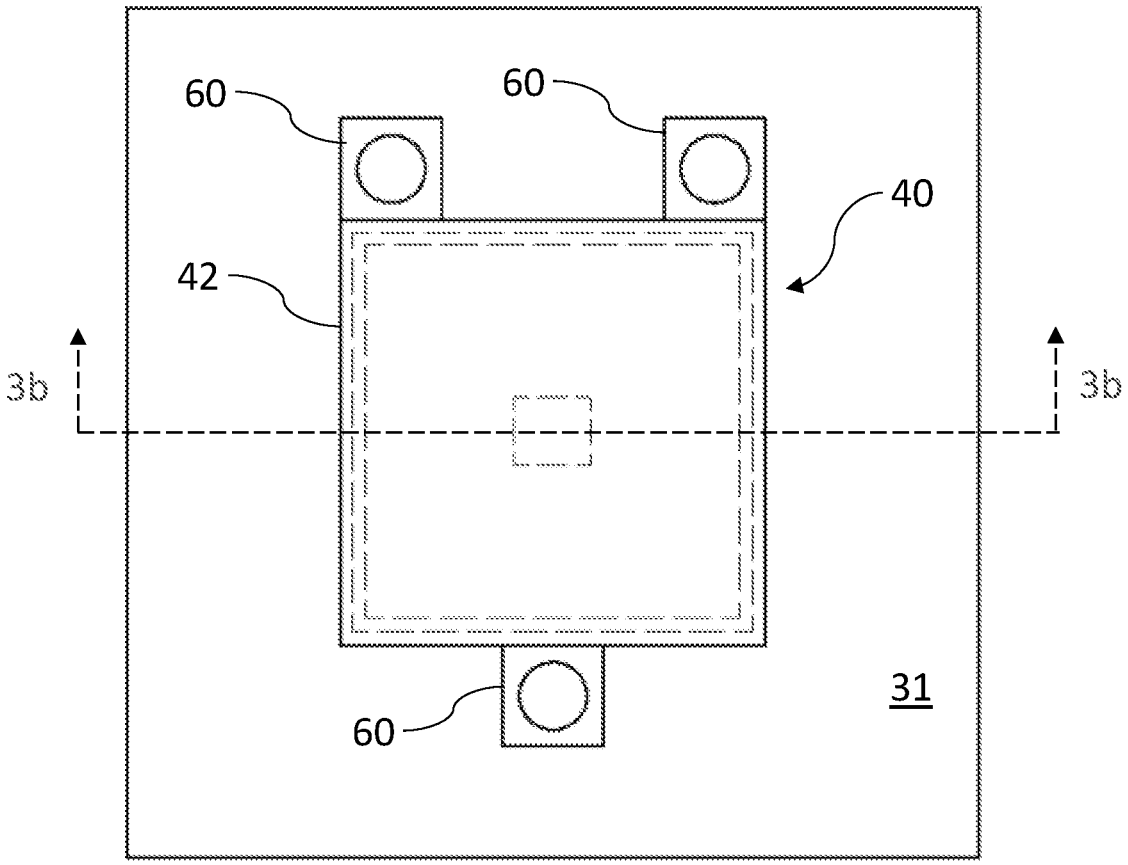
FIGS. 3*a*-3*d* are schematics illustrating an embodiment of a gas leak sensor mounted to a mounting surface with three mounting protrusions integrally formed with the side walls in accordance with an aspect of the present invention.
Figure 3B:
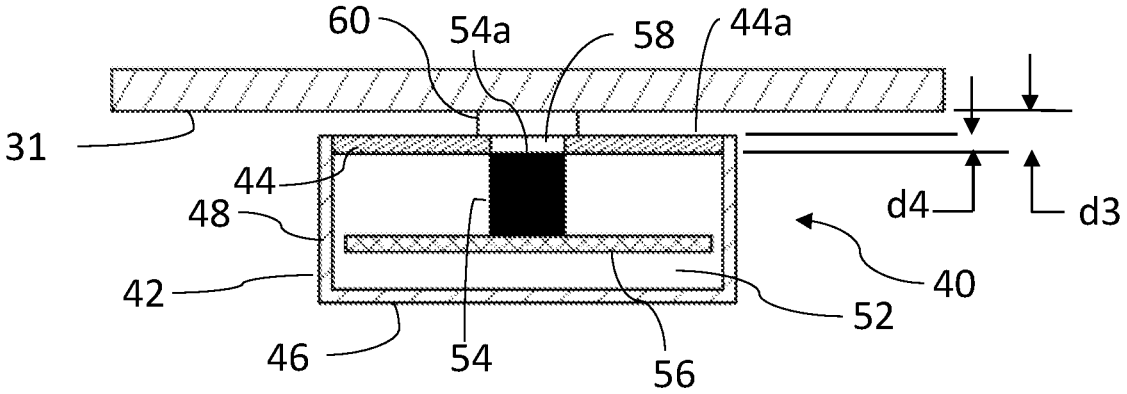
Figure 3C:
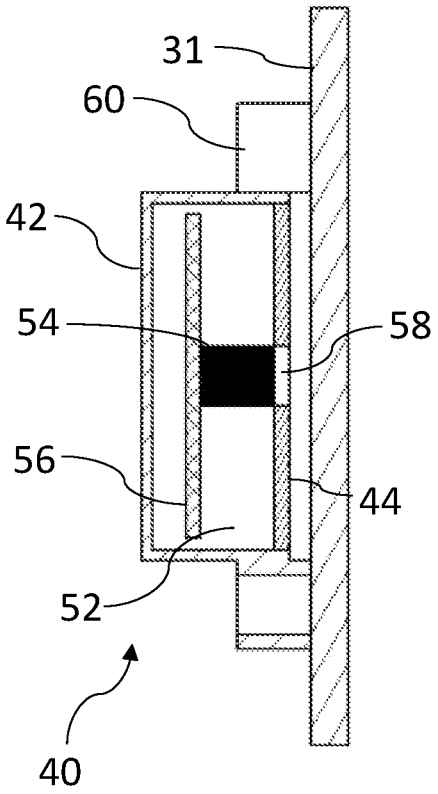
Figure 3D:
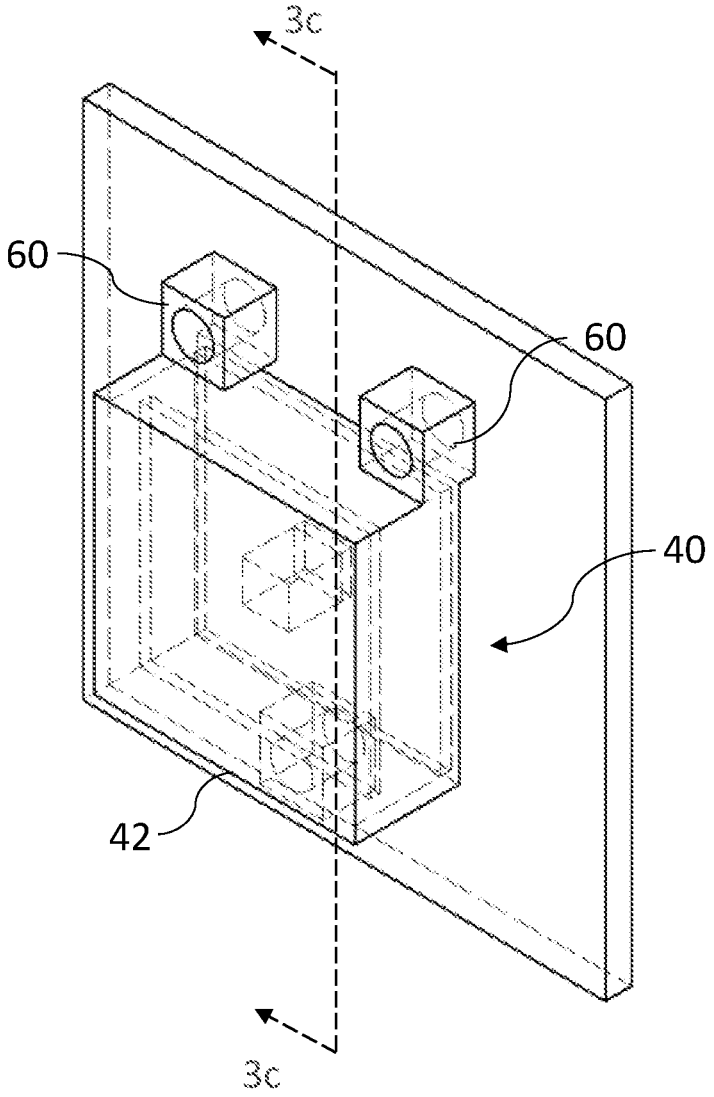
Figure 4A:
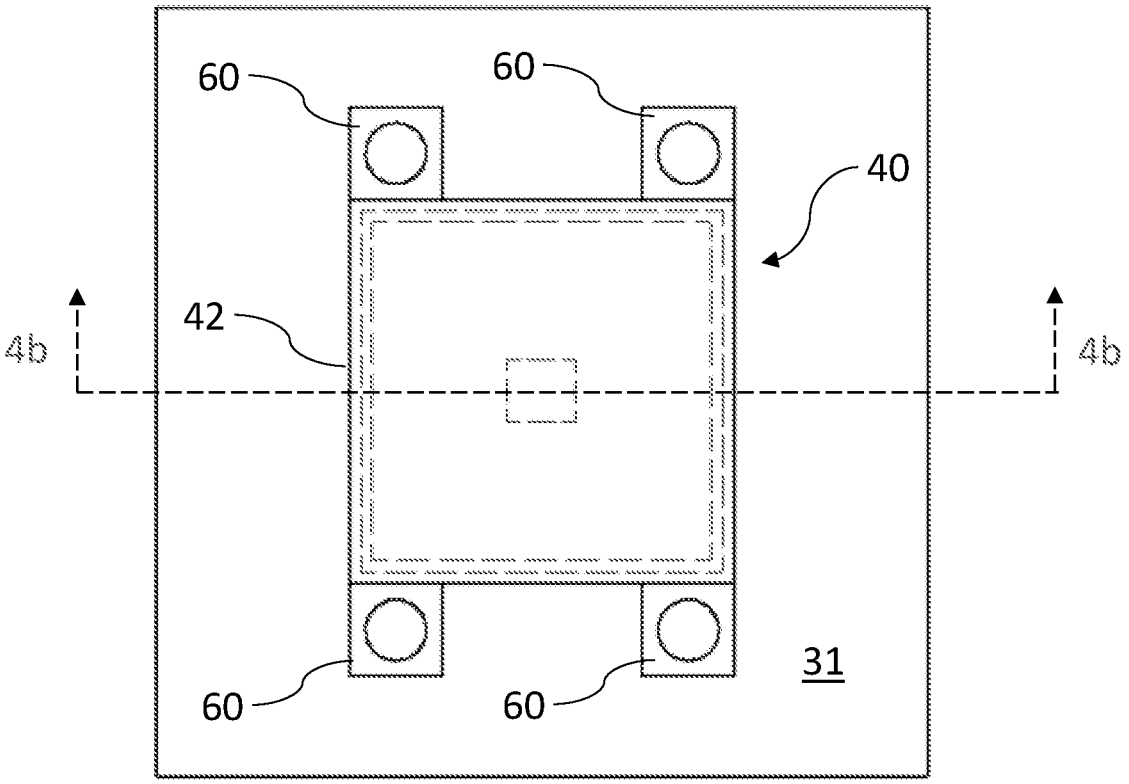
FIGS. 4*a*-4*d* are schematics illustrating an embodiment of a gas leak sensor mounted to a mounting surface with four mounting protrusions in accordance with an aspect of the present invention.
Figure 4B:
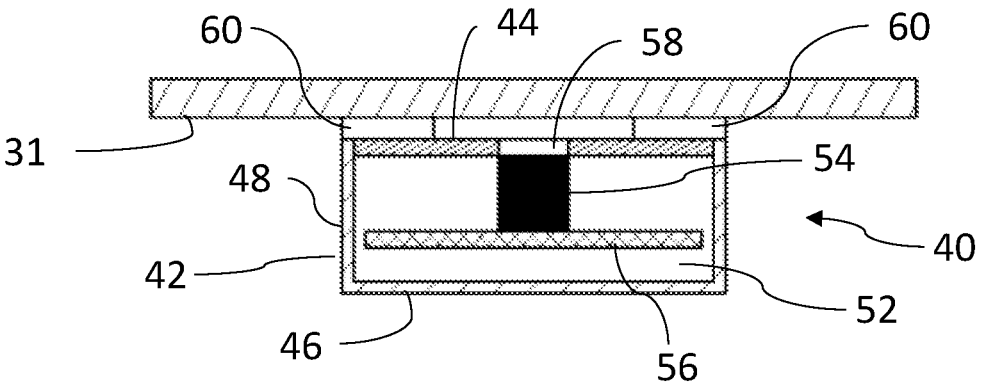
Figure 4C:
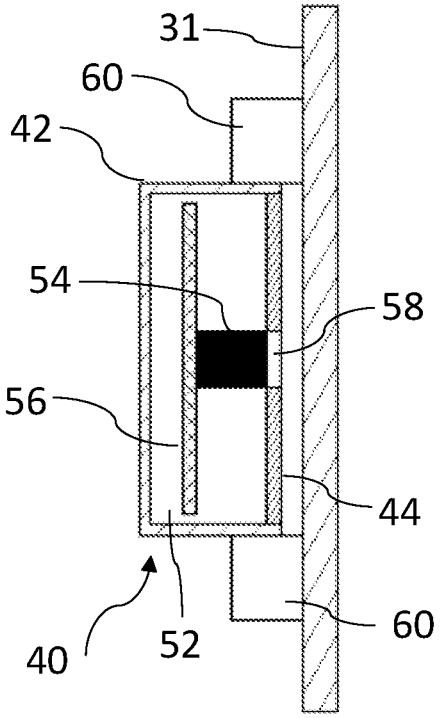
Figure 4D:
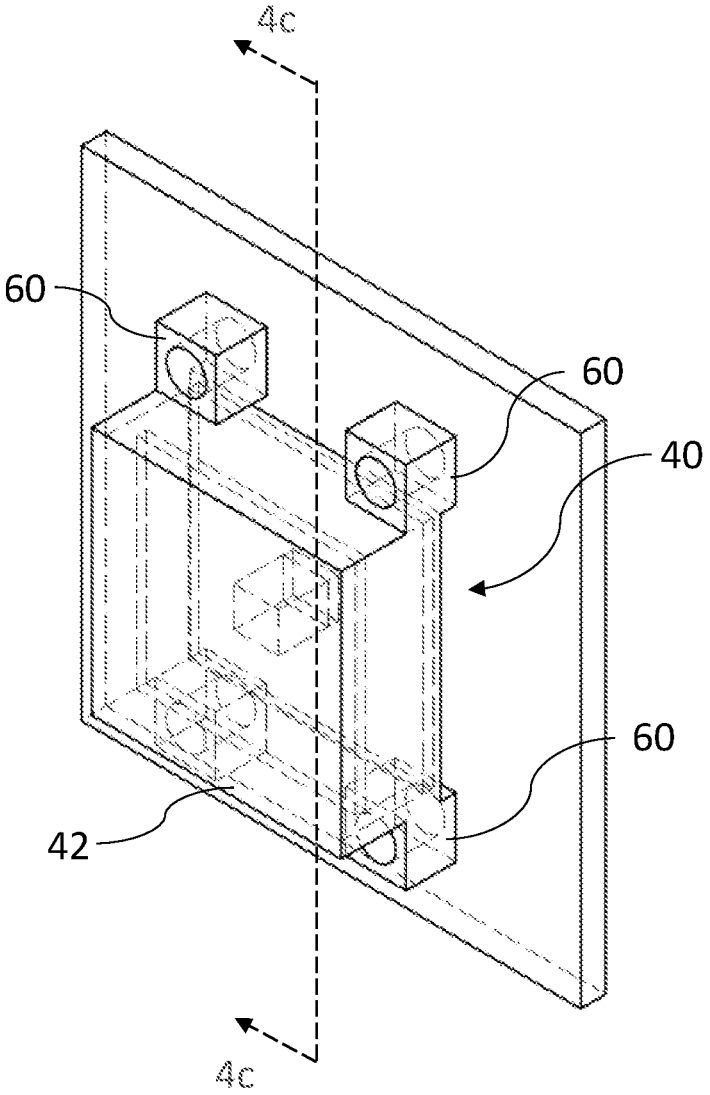
Figure 6A:
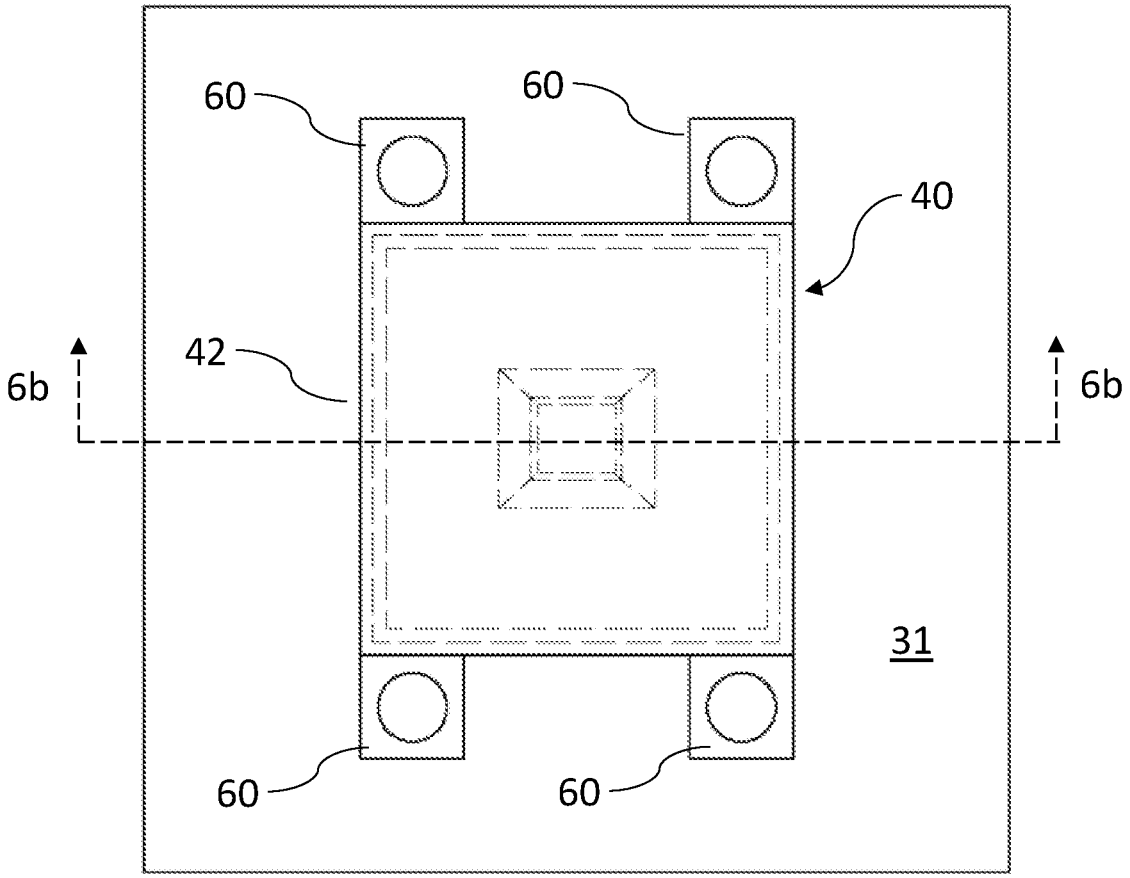
FIGS. 6*a*-6*d* are schematics illustrating an embodiment of a gas leak sensor with a tapered ducting member in accordance with an aspect of the present invention.
Figure 6B:
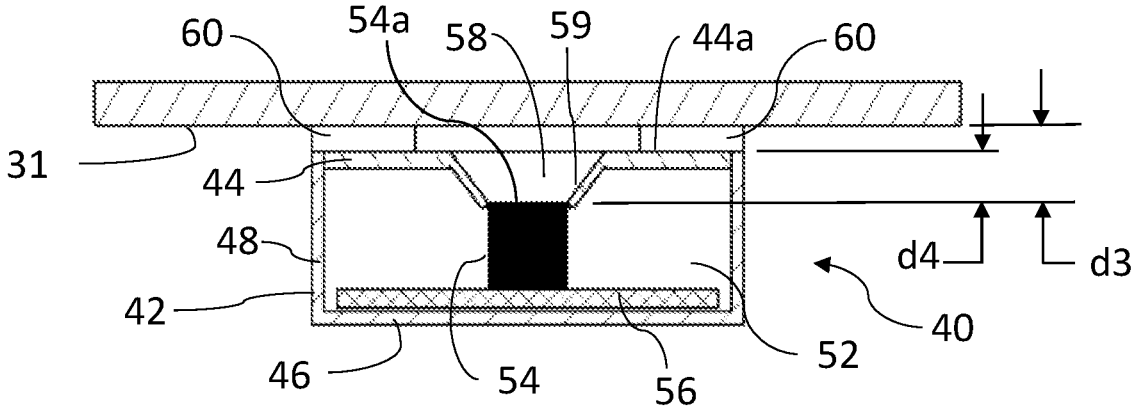
Figure 6C:
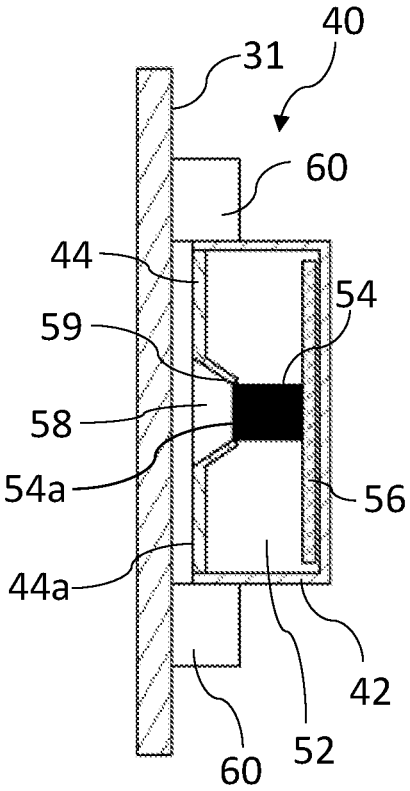
Figure 6D:
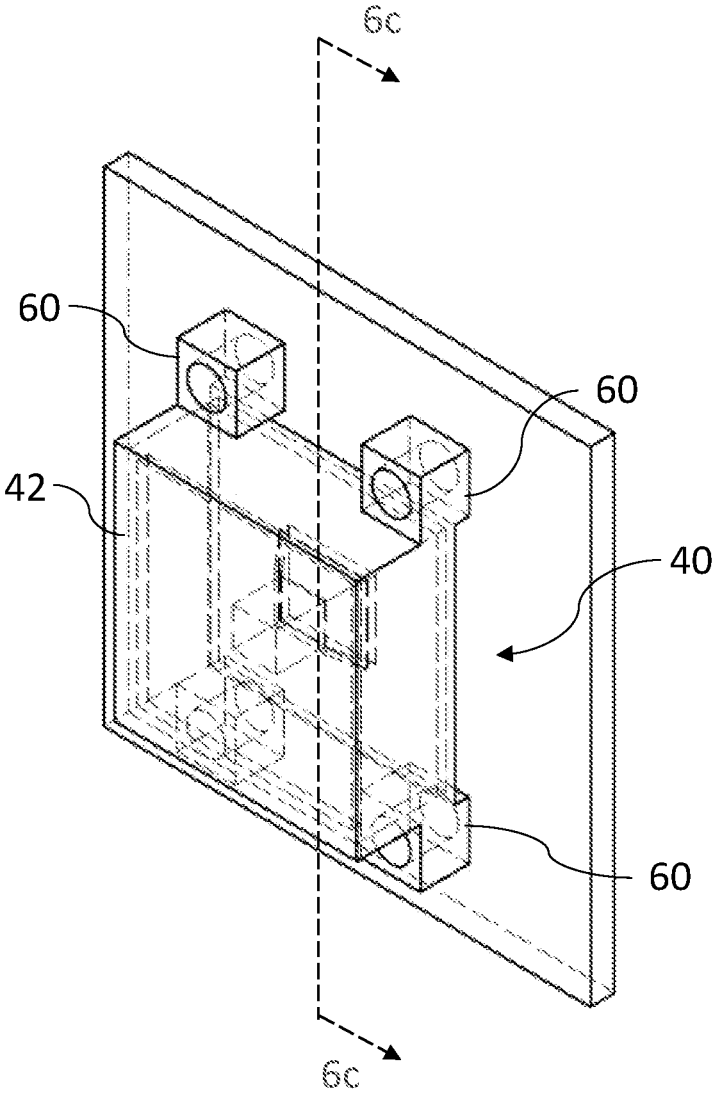

Referring to FIGS. 3*b* and 6*b*, according to certain embodiments, a gas sensing surface 54*a* of the gas sensor core element 54 may be located at a distance 'd3' from the mounting surface 31 or at a depth or distance 'd4' from the first surface 44*a*. Thus, depending upon the likelihood of contamination, the sensing surface 54*a* may be located close to or even flush with first surface 44*a* (low likelihood of contamination) as shown in FIG. 3*b*, or may be located within the inner volume 52 and below first surface 44*a* as shown in FIG. 6*b*. The distance 'd4' between the first surface 44*a* and the sensing surface 54*a* may be less than 20 mm and/or greater than 0 mm.

Optionally, as best shown in FIGS. 6*a*-6*d*, housing 42 may include a duct member 59 extending within inner volume 52 between opening 58 and sensor core 54. Duct member 59 may be tapered, i.e., the cross-sectional area of such of duct member 59 decreases from opening 58 towards the sensor core 54, so as to improve the response time of gas leak sensor 40 by guiding the external air or gas to sensor core 54. The tapered duct member 59 may have a truncated, pyramidal shape as shown in FIGS. 6*a*-6*d*. Other shapes, for example, a truncated, conical shape may be provided. When first plate element 44 is oriented in a vertical direction, this conical configuration may prevent or inhibit any oil flowing on the outer surface of housing 42, especially any oil flowing on first plate element 44 which is provided with opening 58, from reaching sensor core 54. Optionally, duct member 59 need not be tapered.

Figure 5A:
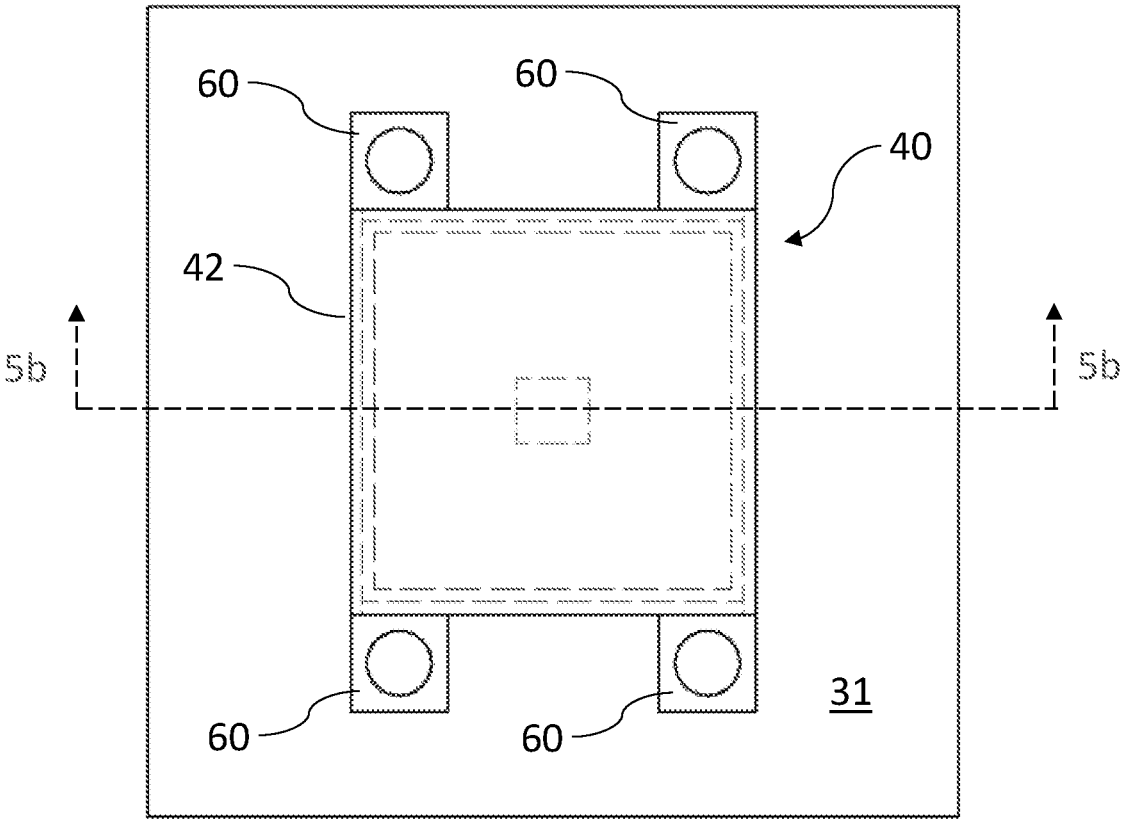
FIGS. 5*a*-5*d* are schematics illustrating an embodiment of a gas leak sensor mounted to a mounting surface and having two extended side walls in accordance with an aspect of the present invention.
Figure 5B:
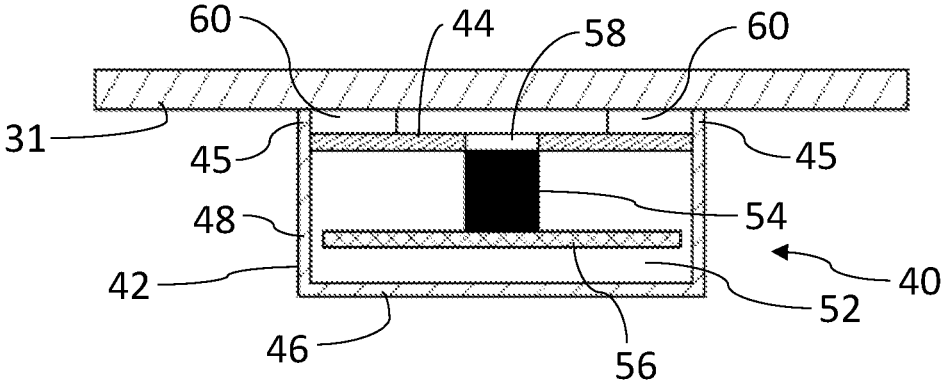
Figure 5C:
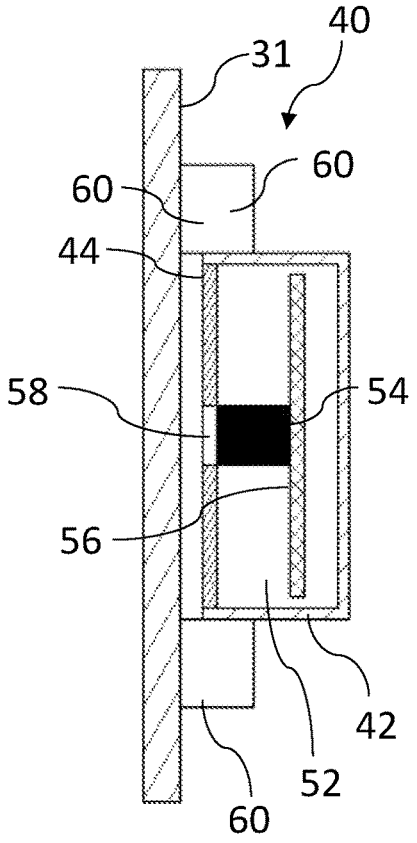
Figure 5D:
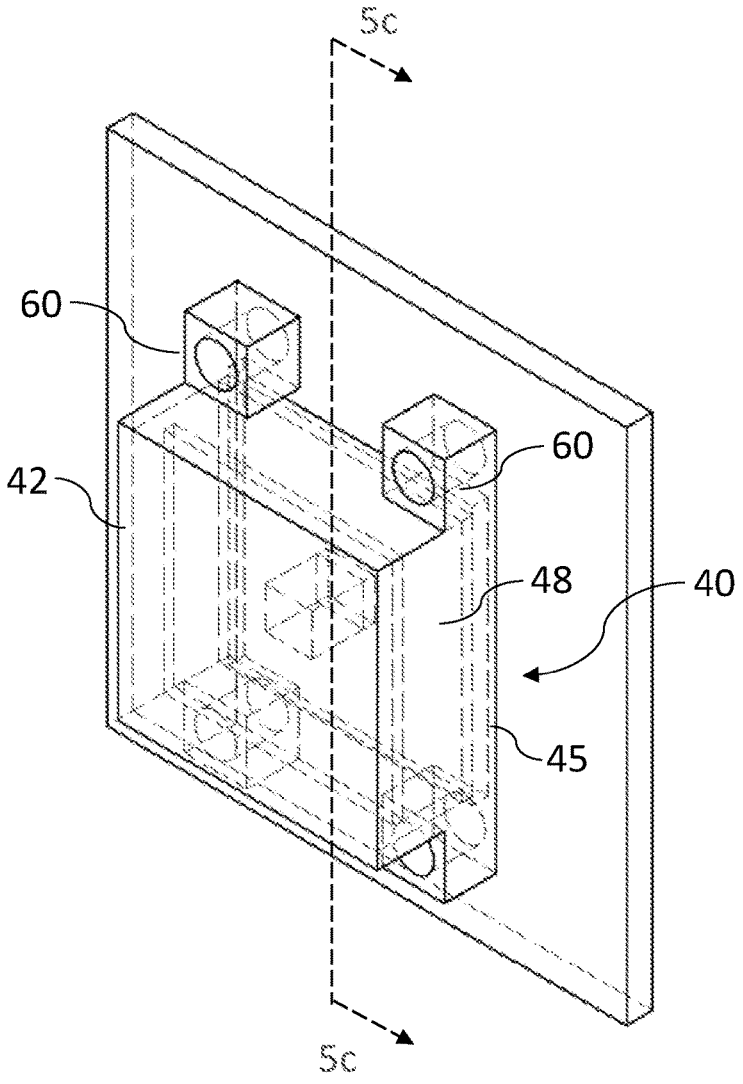

As disclosed above, the housing 42 includes primary walls 44, 46, 48 delimiting an inner volume 52. Referring to FIGS. 5*a*-5*d*, according to certain embodiments, the housing 42 may further include one or more secondary walls not delimiting the inner volume. The secondary walls may be provided as extensions or as additional wall portions from the primary walls and may function to prevent sprayed oil (or other contaminants) from reaching and/or entering opening 58. Thus, for example, as shown in FIGS. 5*b* and 5*d*, secondary walls 45 may be provided as extensions of side walls 48. These secondary walls 45 extend toward the mounting surface 31 to at least partially block the gap 62 and thereby reduce the total cross-sectional area encompassed by the edges of gap 62. Other secondary wall portions (not shown) may protrude from first and/or second plate elements 44, 46 and/or from side walls 48 to deflect and/or redirect any sprayed oil that contacts refrigerant gas leak sensor 40. For example, such a secondary wall portion could be a circular wall or a raised annular protrusion extending around opening 58 from surface 44*a* or one or more skirted wall portions flaring out beyond the primary side walls 48. According to other embodiment, mounting means 60 and/or mounting surface 31 may include additional wall portions designed to prevent sprayed oil or other contaminants from reaching and/or entering opening 58.

It should be noted that the terms, such as "comprising," "including" or "having," should be understood as not excluding other elements or steps and the words "a" or "an" should be understood as not excluding plurals of the elements or steps.

While the present disclosure has been illustrated and described with respect to one or more particular embodiment thereof, it should be appreciated by those of ordinary skill in the art that various modifications to this disclosure may be made without departing from the spirit and scope of the present disclosure.

The invention claimed is:

1. A refrigerant gas leak sensor for a HVAC system, the sensor comprising:

a housing having primary walls delimiting an inner volume;

a gas sensor core element arranged in the inner volume;

mounting means configured to attach the housing to a mounting surface with a first surface of a primary wall of the housing facing the mounting surface; and an opening formed in the housing for exposing the gas sensor core element to gases within the HVAC system;

wherein the opening is provided on the first surface, wherein the gas sensor core element has a gas sensing surface that faces the mounting surface, and wherein the housing includes a UV resistant material.

2. The refrigerant gas leak sensor according to claim 1:

wherein the mounting means provides a gap between the first surface and the mounting surface; and wherein the gap has a width measured between the opening and the mounting surface that is less than 15 mm and greater than 1 mm.

3. The refrigerant gas leak sensor according to claim 1:

wherein the mounting means provides a gap between the first surface and the mounting surface; and wherein the gap has a width measured at an edge of the housing between the first surface and the mounting surface that is less than 20 mm and greater than 1 mm.

4. The refrigerant gas leak sensor according to claim 1:

wherein the mounting means provides a gap between the first surface and the mounting surface; and wherein the opening is located a minimum distance from an edge of the gap, and wherein the minimum distance is less than 5 cm and greater than 0.1 cm.

5. The refrigerant gas leak sensor according to claim 1:

wherein a total cross-sectional area of the first surface is less than 50 $cm^2$ and greater than 10 $cm^2$.

6. The refrigerant gas leak sensor according to claim 1:

wherein the mounting means provides a gap between the first surface and the mounting surface; and wherein the gap has a total volume that is less than 40 $cm^3$ and greater than 1 $cm^3$.

7. The refrigerant gas leak sensor according to claim 1:

wherein the gas sensing surface is flush with the first surface.

8. The refrigerant gas leak sensor according to claim 1:

wherein the gas sensor core element contacts an inner surface of the housing and blocks the opening.

9. The refrigerant gas leak sensor according to claim 1:

wherein the gas sensing surface is within the inner volume, and wherein a ducting element extends within the inner volume from the opening on the first surface toward the gas sensing surface.

10. The refrigerant gas leak sensor according to claim 1:

wherein a distance between the first surface and the sensing surface is less than 20 mm and greater than 0 mm.

11. The refrigerant gas leak sensor according to claim 1:

wherein the housing further includes one or more secondary walls not delimiting the inner volume, and wherein the secondary wall extends toward the mounting surface along at least a portion of the edge of the housing to at least partially block the gap.

12. An air handling unit for a HVAC system, the unit comprising:

an enclosure for the air handling unit;

a heat exchanger arranged within the enclosure for heat transfer between a refrigerant flowing in refrigerant piping and an air flow passing through the air handling unit; and a refrigerant gas leak sensor according to claim 1 arranged within the enclosure.

13. The air handling unit according to claim 12, further comprising:

a UV source and/or an IR source arranged within the enclosure.

14. The air handling unit according to claim 12, further comprising:

a controller configured to receive signals from the refrigerant gas leak sensor and, when the refrigerant gas leak sensor detects a leak, configured to trigger an alarm, shut a refrigerant valve, operate a fan, and/or open a vent.

15. The air handling unit according to claim 12:

wherein the refrigerant gas leak sensor is located downstream of the heat exchanger.

16. The air handling unit according to claim 12:

wherein the refrigerant gas leak sensor is located downstream of the heat exchanger and a UV source is located upstream of the heat exchanger.

17. The air handling unit according to claim 12:

wherein the refrigerant gas leak sensor is located within the lower half of the enclosure.

18. The refrigerant gas leak sensor according to claim 1:

wherein the opening provided on the first surface is the only means for gas to contact the sensing surface of the gas sensor core element.

19. The refrigerant gas leak sensor according to claim 1:

wherein the housing further includes one or more secondary walls provided as an extension of one or more side walls, and wherein the secondary wall extends toward the mounting surface.

* * * * *